US005454248A

United States Patent [19]

Inatani

[11] Patent Number: 5,454,248

[45] Date of Patent: Oct. 3, 1995

[54] METHOD OF SHAPING A WHEEL

[75] Inventor: Shujiro Inatani, Osaka, Japan

[73] Assignee: Rays Engineering Co., Ltd., Osaka, Japan

[21] Appl. No.: 236,037

[22] Filed: May 2, 1994

[51] Int. Cl.[6] ..... B21H 1/04

[52] U.S. Cl. ..... 72/84; 72/82; 29/894.324

[58] Field of Search ..... 72/67, 68, 82, 72/83, 84, 85, 87, 110; 29/894.324, 894.524

[56] References Cited

U.S. PATENT DOCUMENTS

| | | | |
|---|---|---|---|
| 965,032 | 7/1910 | Slick | 72/84 |
| 3,461,701 | 8/1969 | Marcovitch | 72/84 |

FOREIGN PATENT DOCUMENTS

| | | | |
|---|---|---|---|
| 55-46881 | 11/1980 | Japan . | |
| 59-15733 | 4/1984 | Japan . | |
| 3-2573 | 1/1991 | Japan . | |
| 261463 | 10/1993 | Japan | 72/85 |
| 1761349 | 9/1992 | U.S.S.R. | 72/67 |

*Primary Examiner*—Lowell A. Larson
*Attorney, Agent, or Firm*—Steven M. Rabin

[57] ABSTRACT

A method of forming wheels such as automobile wheels that consist of a disc part and a peripheral rim part. The wheel's disc part is formed by forging. Then the rim part is shaped by rolling. An initial material is formed beforehand so as to combine a central disc part and a peripheral annular part. One ram has a pressing surface for shaping an outer side of the disc part and a peripheral surface for shaping an outer rim. The other ram has a pressing surface for shaping an inner side of the disc part and a peripheral surface for shaping an inner rim. The rams rotate on their axes synchronously in the same direction and press the central disc part for shaping the disc part of the wheel. At the same time or afterward a shaping roller forms a rim part by pressing the peripheral part from the side.

18 Claims, 8 Drawing Sheets

METHOD OF SHAPING A WHEEL

This application claims the priority of Japanese Patent Application No. 4-307347 (307347/1992) filed Nov. 17, 1992, which are incorporated herein by reference.

FIELD OF THE INVENTION

This invention relates to a method of shaping various types of wheels combining a disc part, and a rim part which are made from materials highly subject to plastic deformation, for instance, aluminum alloys or magnesium alloys.

BACKGROUND OF THE INVENTION

Automobile wheels or transmission pulleys are formed into a disc part and a peripheral rim part which is roughly perpendicular to the disc part in a unified body. Since the rim has an annular part projecting outwardly, the wheel can be not manufactured only by a single forging process. Thus, the prior method exhibited in Japanese Patent Publication No. 3-2574 has produced a disc-shaped prototype to the final shape by forging, except an annular part. The peripheral annular part is then formed into a determined rim part by rolling formation. The conventional method of producing a light alloy wheel requires separate processes, one of which is a forging process for finishing the disc part to its final shape and the other is a spinning process for finishing the rim part to its final shape. Thus, in the conventional manufacturing line, it is necessary that a forging apparatus and a spinning apparatus are used separately. Moreover, it is necessary to store semifinished items between the forging process and the spinning process.

Accordingly in the prior method, a large space is required to manufacture the wheel. And different rams are required for each process. Moreover, since the wheel is finished to its final shape through at least two processes, it takes a long time to produce the wheel in its final shape. Therefore, a light alloy wheel can not be produced at low cost.

An object of this invention is to provide a method of shaping a wheel, that includes a disc part and a peripheral rim part which are made from materials highly subject to plastic deformation, in a unified body in a small space occupied by apparatuses for shaping a disc part and for shaping a rim part. Another object of this invention is to provide a method of shaping a wheel which can save process time. A still further object of this invention is to provide a method which can reduce the number of rams.

SUMMARY OF THE INVENTION

The method of this invention comprises includes forming an initial material 10 combining a central disc part 11 and a peripheral annular part 12, facing a pair of metallic rams 3*a*, 3*b*. One of the rams has a first pressing surface 31 for shaping an outer surface of a disc part 1 and a peripheral surface 32 for shaping an outer rim part. The other metallic ram 3*b* has a second pressing surface 33 for shaping an inner surface of the disc part 1 and a peripheral surface 34 for shaping an inner rim part. A movable shaping roller 4 is provided outward of a boundary between the rams 3*a*, 3*b*. The peripheral annular part 12 of the initial material 10 is fitted on at least one of the rams 3*a*, 3*b*. The central disc part 11 is pressed by the rams 3*a*, 3*b* which rotate synchronously on their axes in the same direction for forming the disc part 1. The peripheral annular part 12 is pressed by the shaping roller 4 for shaping the peripheral part into at least an outer half of a drop center and the outer rim part, with the rams 3*a*, 3*b* rotating.

Functions of this method will be explained now. The initial material 10 is sandwiched by the pair of rams 3*a*, 3*b*. The rams press the initial material 10 in an axial direction. The material is squashed into a disc part 1. At the same time or after the disc part is formed, a shaping roller 4 moves inwardly along a stated moving route, so that a peripheral annular part 12 is pressed from the side direction and is shaped into rim parts by the shaping roller 4, because the central disc part is sandwiched and rotated by the rams 3*a*, 3*b*. During this time the whole of the rim part may be shaped by one shaping roller. Or at least a part of the rim which covers from the outer half of the drop center to the outer rim may be shaped first by one shaping roller, and then the other rim parts may be shaped by spinning.

In this way the disc part 1 and the rim parts are formed at the same time or continuously by one apparatus.

The advantages of this invention are high productivity, low production cost, a short time for formation and reduced workshop space requirements, because the disc part 1 and the rim parts 2 of the automobile wheel are formed out of the initial material 10 at the same time or continuously by one apparatus without removing a workpiece. And because the metallic rams for forging and spinning are common, only a small number of metallic rams is required.

Another method of this invention includes slightly tilting an axis of a metallic ram 3*b* from a perpendicular axis of a metallic ram 3*a*. The ram 3*b* has a gentle conical pressing surface 33. The central disc part 11 of the initial material 10 is pressed by the rams 3*a*, 3*b* while they rotate synchronously on their axes in the same direction for forming the disc part 1. The peripheral part 12 of the initial material 10 is pressed by a shaping roller 4 from the tilted side of the ram 3*b*, with the rams 3*a*, 3*b* rotating.

In this method, when the disc part 1 is formed out of the initial material 10 by pressing between the metallic rams 3*a*, 3*b*, since the ram 3*b* rotates on its own axis which inclines slightly relative to the axis of the vertical ram 3*a*, and since the shaping roller 4 is provided outward of a boundary of the rams 3*a*, 3*b*, the disc part 1 is formed by precession. Thus, the outer surface of the disc part 1 is completed after a sectional shape of the first pressing surface 31, and an inner surface of the disc part 1 is completed after a sectional shape of the second pressing surface 33.

Since a pressure during this time corresponds with a needed pressure for manufacture of a part of the central disc part 11 which contacts with very few parts of the ram 3*b*, the forming pressure applied by the rams 3*a*, 3*b* to the initial material 10 in the axial direction can be reduced. And since the pressure applied by the rams 3*a*, 3*b* in the axial direction and a pressure applied by the shaping roller 4 in the radial direction act on the initial material 10 at the same time, an uneven surface of the disc part 1 is shaped correctly.

The peripheral surface 32 is adapted to shape an inner surface of an outer rim and an outer surface of a flange next to the outer rim.

When a generatrix of the inclined ram 3*b* is suitable to shape an inner surface of the inner rim and an outer surface of a flange next to the inner rim, the shaping roller 4 moves inward along a predetermined route as the rams 3*a*, 3*b* press the initial material 10; hence, the peripheral annular part 12 can be formed into the rim parts.

While, in the case of a non-inclined ram 3*b* and when a generatrix of the shaping roller side of the ram 3*b* is suitable to a shape of the inner surface of the inner rim and the outer surface of the flange next to the inner rim, a part of the inner rim is formed by the tilted ram 3b, and then the tilted ram 3b is restored to the vertical position, after which the inner rim part of the wheel is finished to a final sectional shape.

DETAILED DESCRIPTION OF PREFERRED EMBODIMENTS

Figure 1:
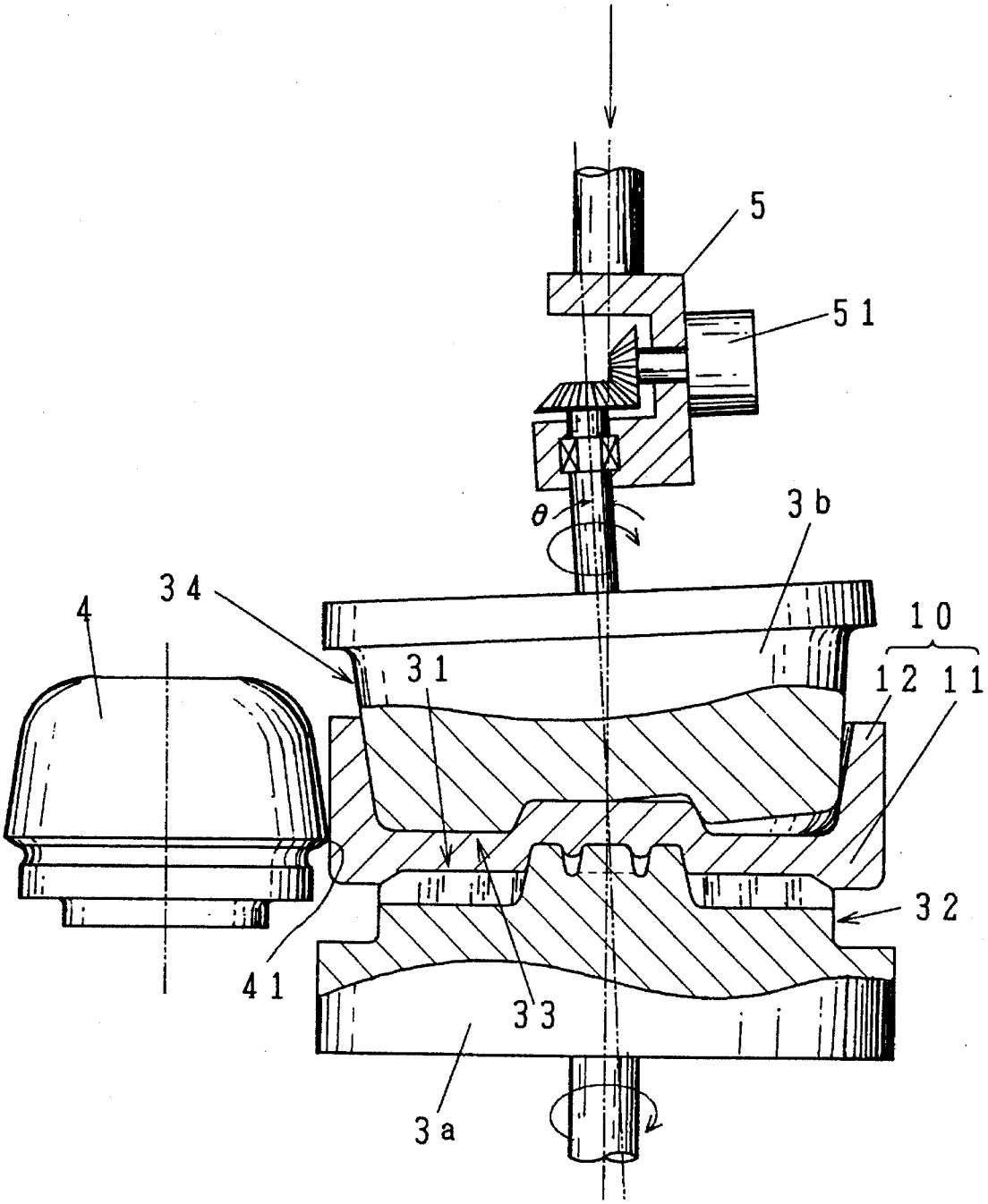
FIG. 1 is a sectional view showing an initial material put in an apparatus.

Embodiments of this invention are explained in accordance with the figures.

The apparatus has a pair of rams 3a, 3b facing each other in the vertical direction. The lower ram 3a is rotatable at a fixed vertical position. The upper ram 3b is movable up and down. A shaping roller 4 is disposed outward of a sandwiched space between the rams 3a, 3b, in a vertical posture.

The upper ram 3b is supported by a holder 5 so as to rotates on its own axis which inclines by θ degrees relative to the axis of the lower ram 3a. The holder 5 is lowered in the axial direction of the ram 3a. And the holder 5 has a driving device 51 for moving the upper ram 3b rotatably.

An initial material 10 comprising a central disc part 11 and a peripheral annular part 12 is laid between the lower ram 3a and the upper ram 3b. The thickness of the central disc part 11 corresponds to the thickest portion of a disc part 1 of a finished wheel or more, while, thickness in the horizontal direction of the peripheral annular part 12 is thicker than that of rim parts 2 of the finished wheel. The width in the vertical direction of the peripheral annular part 12 is shorter than that of the finished rim parts 2. It is to be desired that a volume of the central disc part 11 is set slightly larger than that of the disc part 1 of the finished wheel, and a volume of the peripheral rim part 12 is set larger than that of the rim parts 2 of the finished wheel.

Figure 5:
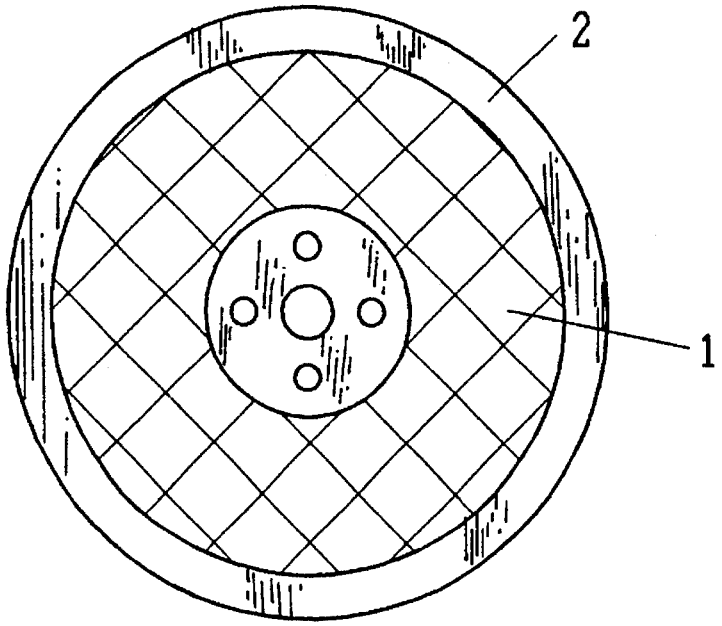
FIG. 5 is a plan view of an outer surface of a wheel.

The upper surface of the lower ram 3a is a first pressing surface 31 which is a negative of the outer side of the disc part 1 of the wheel. The first pressing surface 31 is shaped after the disc part 1. The disc part 1 will have concave or convex patterns as shown in FIG. 5. The first pressing surface 31 must have negative patterns similar to the concave or convex patterns of the disc part 1. The relation of convex and concave portions is reverse between the first pressing surface 31 and the disc part 1. A peripheral surface 32 has a sectional shape which is a negative of a part of the inner surface of the outer rim 2a and an outer surface of a flange next to the outer rim.

Similarly, the upper ram 3b is shaped so as to fit to form the inner side of the disc part 1 and the inner rim 2b by rotary forging. In this embodiment the second pressing surface 33, which faces the inner side of the disc part 1, has been shaped into about a gentle cone. An inclination of a generatrix of the cone (an angle against a plane falling at right angles with the axis of the upper ram 3b) corresponds with the angle of inclination (θ) of the axis of the upper ram 3b. Namely in this embodiment the lower left generatrix of the pressing surface 33 shown in FIG. 1 is constantly at right angles to the rotation axis of the lower ram 3a, in other words, it is parallel to the rotation surface of the first pressing surface 31. A peripheral slanting surface 34 of the upper ram 3b is tapered generally. A sectional shape of the tilt side of the upper ram 3b is a negative of the inner surface of the inner rim 2b and an outer surface of a flange next to the inner rim.

The shaping roller 4 is disposed at the tilt side of the upper rim 3b and outside of the interface between the upper ram 3b and the lower ram 3a. The shaping roller 4 is supported rotatably on its own axis and is movable in a radius direction or along the first peripheral surface 32 and the second peripheral surface 34 while maintaining its vertical posture.

In this embodiment, an outer half of a drop center and an outer surface of the outer rim 2a of the rim parts 2 are formed by the shaping roller 4, while the annular flange 22 next to the inner rim 2b and a tire bead portion 23 are finished by another forming roller 40.

Thus, a lower part of the shaping roller 4 has a sectional shape which is a negative of a part of the drop center and an outer surface of the outer rim 2a, while a shape of an upper part of the shaping roller 4 is shaped like a truncated and chamfered cone.

FIG. 1 to FIG. 4 demonstrate how to produce a wheel from an initial material 10. In this method the rams 3a, 3b are made to rotate synchronously and the central disc part 11 is finished into the disc part 1 first, after which the peripheral annular part 12 is finished into the rim parts 2. A sectional shape of the initial material 10 is shaped beforehand so as to adapt to the finished wheel.

The initial material 10 is laid on the lower ram 3a and then the upper ram 3b is lowered so that the initial material 10 may be is pressed by the rams 3a, 3b, as shown in FIG. 1. At the same time, the shaping roller 4 comes into contact to the outer side surface of the initial material 10, so that the largest diameter portion 41 of the shaping roller 4 can coincide with the outer side surface of the central disk part 1.

Figure 2:
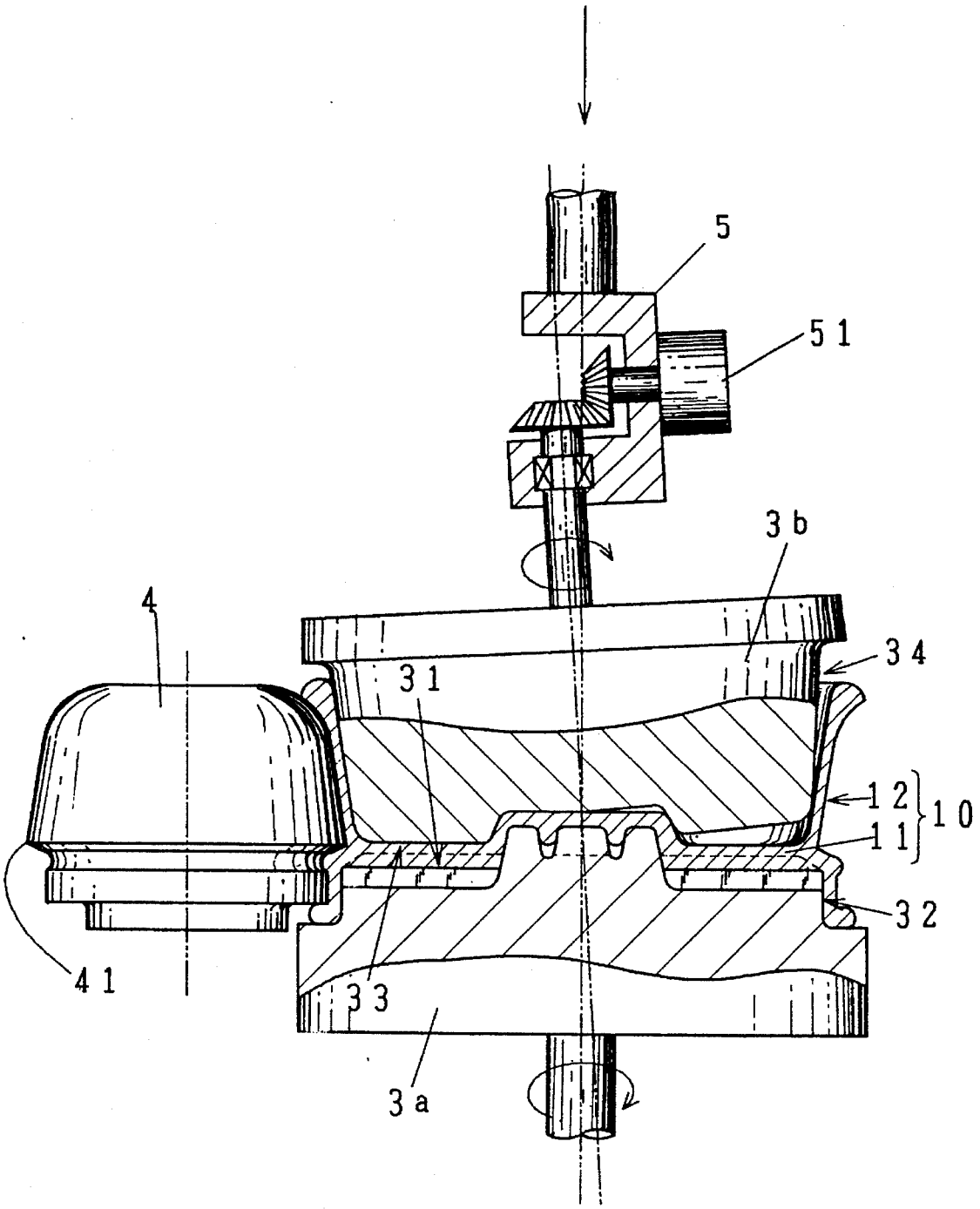
FIG. 2 is a sectional view of the material, the rams and a side roller at an early stage of forging.

In this condition as shown in FIG. 2, the rams 3a, 3b are made to rotate synchronously in the same rotational direction and the ram 3b is pressed downwards. At the same time, the shaping roller 4 is made to move inwardly in the radius direction. Hence the peripheral annular part 12 is pressed so that its thickness of which is decreased. By continuation of this condition, the material for the central disc part 1 fills into the concave patterns and is displaced by the convex patterns of the first pressing surface 31 as a result of its precessive movement. Namely, the forming of the disc part 1 can be finished. During this time, since the material corresponding to the central disc part 11 is pressed from the outside by the shaping roller 4, the material is filled into the concave patterns and displaced by the convex patterns with certainty without an extrusion out of the disc part 1. Further when the shaping roller 4 is pressed against the peripheral annular part 12 at a position where a distance between the shaping roller 4 and the second peripheral slanting surface 34 is smaller than a distance between the shaping roller 4 and the first peripheral surface 32, the above mentioned effect will be improved all the more.

And at this time, when the shaping roller 4 is moved along the stated route, a part of the material corresponding to the peripheral annular part 12 can be shaped into an intermediate form of the rim parts 2 by pressure between the shaping roller 4 and the second peripheral slanting surface 34 and between the shaping roller 4 and the first surface 32.

Figure 3:
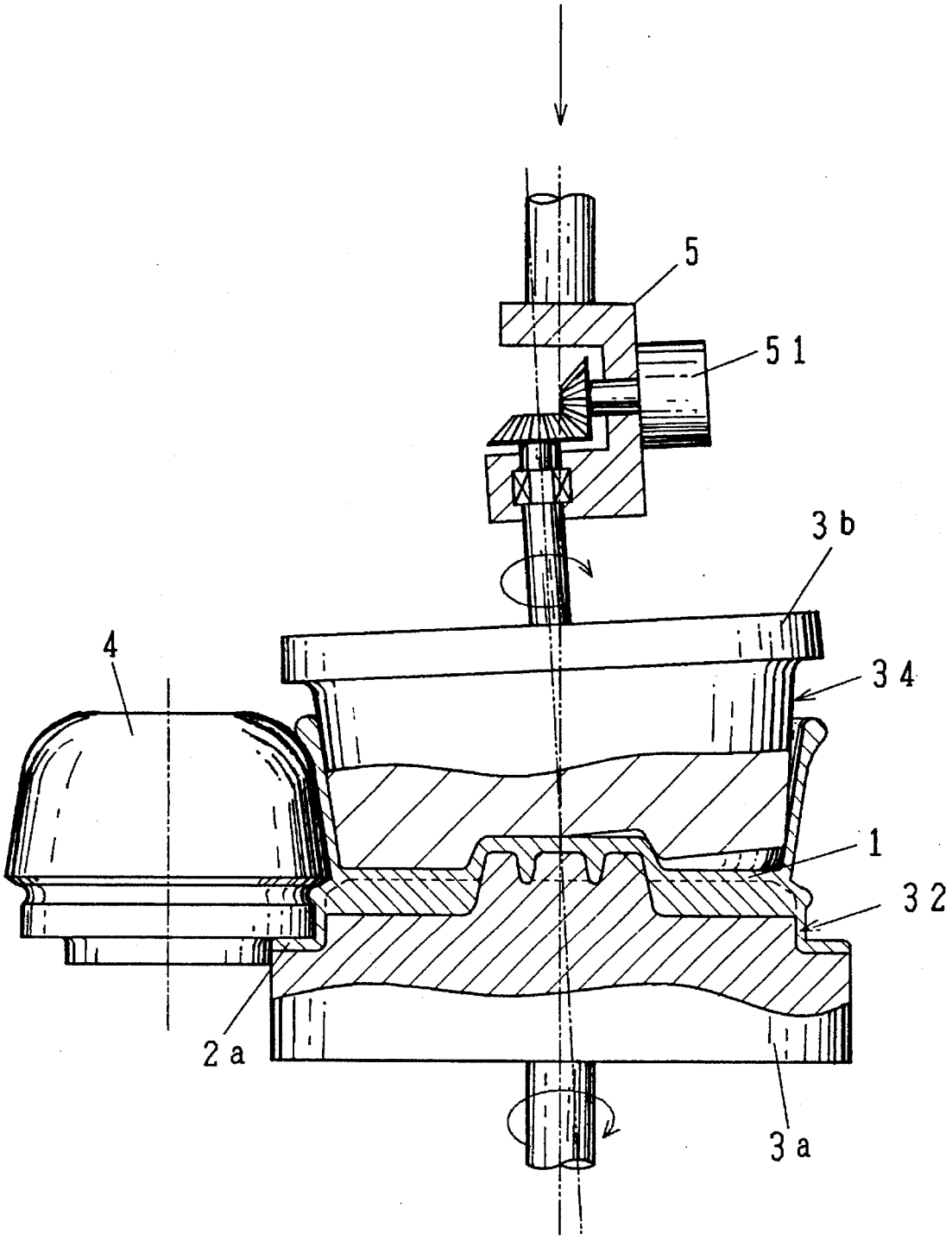
FIG. 3 is a sectional view of a disc part of the material and the rams at a final stage of forging.
Figure 4:
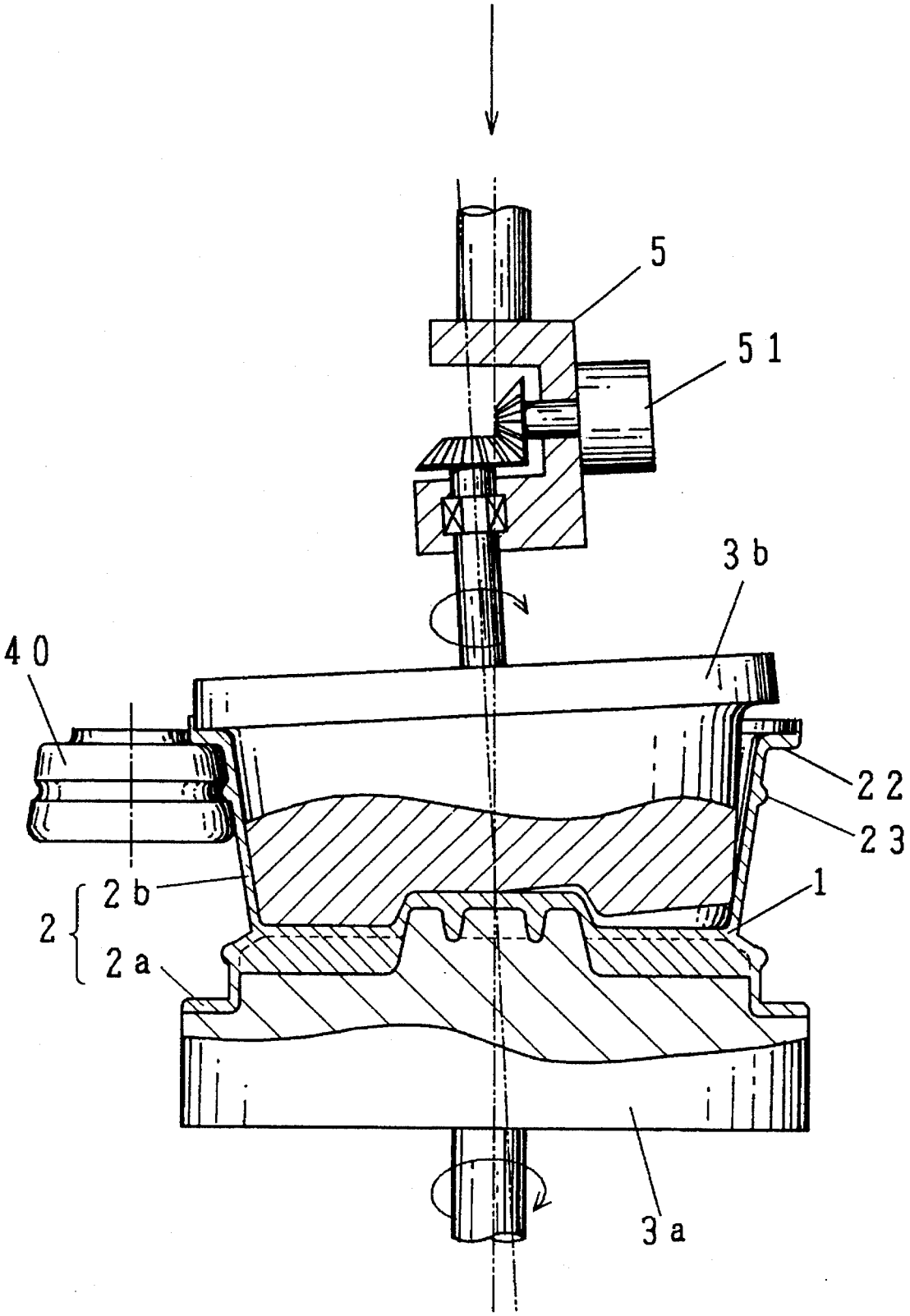
FIG. 4 is a sectional view of a rim part of the material and the side roller at the final stage.

After that, as shown in FIG. 3, the pressure of the upper ram **3*b* against the lower rams 3*a* is reduced to a certain extent so that disc part 1 is not crushed. In this condition, the rams 3*a*, 3*b* rotate and at the same time the shaping roller 4 comes into contact with the peripheral material in order to shape the outer half of the drop center and the outer rim 2*a* of the rim parts 2. After that, the inner half of the drop center and the inner rim 2*b* of the rim parts 2 are formed by another forming roller 40 as shown in FIG. 4**.

In this embodiment, the sectional shape of the rim parts 2 is finished after the disc part 1 has been finished. However, almost all of the process to shape the rim parts 2 may proceed together with the process to form the disc part 1.

Figure 6:
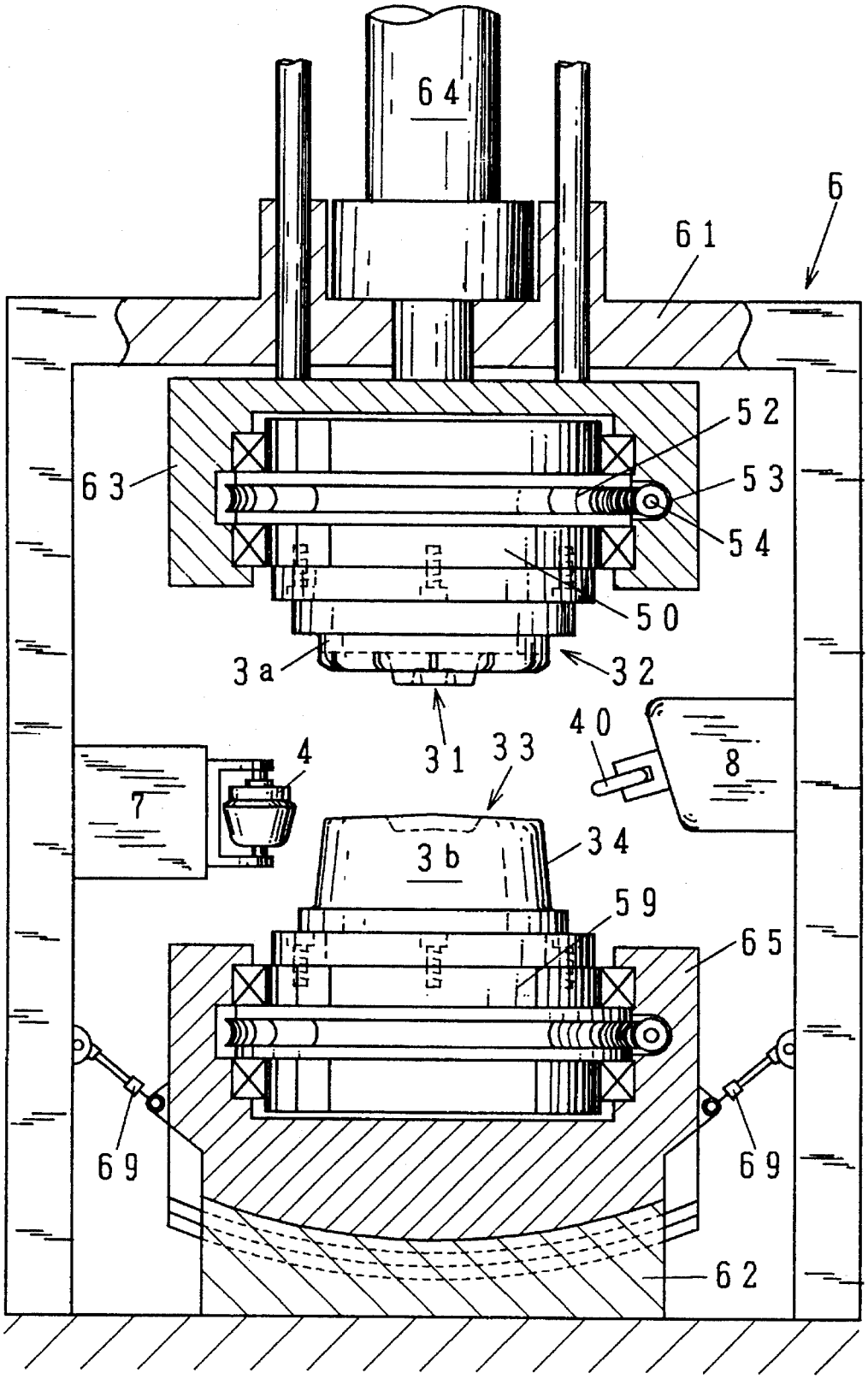
FIG. 6 is sectional view of the apparatus for putting this invention into effect.

An apparatus shown in FIG. 6 can be adapted to carry out the method of shaping the wheel according to present invention.

In the apparatus, the upper ram **3*a* is suspended from a top deck 61 of a frame 6, while the lower ram 3*b* is founded on a fixed bed 62. A cylindrical holder 63 hung from the top deck 61 has an opening at the bottom. The rotary bed 50 is rotatably equipped at the bottom opening of the holder 63. The upper ram 3*a* is fixed to the bottom of the rotary bed 50. The holder 63 is fitted to an output shaft of the oil pressure (hydraulic) device 64. Guide posts fixed to the holder 63 penetrate holes of the deck 61. The oil pressure device can lift or lower the holder 63. The rotary bed 50 can rotate with respect to the holder 63. A worm wheel 52 is fitted around the rotary bed 50. The holder 63 has a driving motor (not shown in the figures) with an output shaft 54 for rotating the ram 3*a* and a worm 53 fitted to the output shaft 54. When the driving motor rotates the worm 53, the worm wheel and the ram 3*a* revolve at a reduced velocity. Therefore the upper ram 3*a*** is rotated by the driving motor and the worm gear device and is lifted up or down by the hydraulic device.

The lower ram **3*b* is fixed on a rotary bed 59 which is furnished in a holder 65. The holder 65 is laid on the fixed bed 62. The rotary bed 59 can be rotated by a driving device like the upper ram 3*a***.

Figure 7:
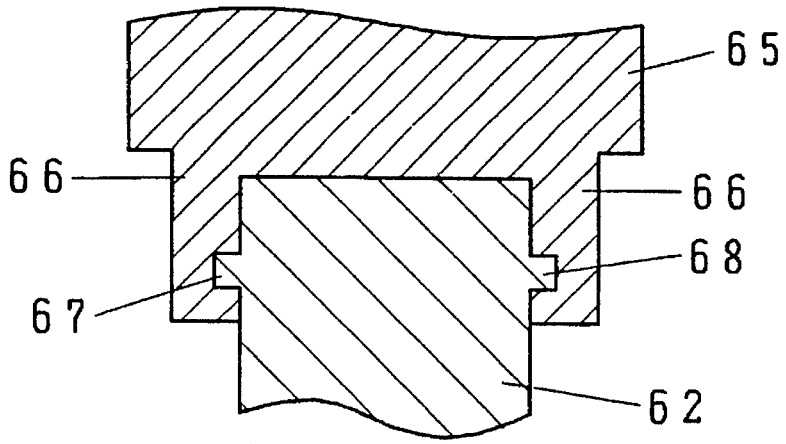
FIG. 7 is a sectional view of a fixed bed and a holder.

A bottom of the holder 65 and a top face of the fixed bed 62 are curved surfaces which fit to each other. Thus, the holder 65 is rotatable on the top face of the fixed bed 62. A center of the curved surface corresponds to a center of a top face of the lower ram **3*b*. Side plates 66 having recessed 67 are provided at both side of the bottom of the holder 65 as shown in FIG. 7, while protrusions 68 project at side surfaces of the fixed bed 62. By fitting the protrusions 68 into the recessed 67, the holder 65 can be securely held in the fixed bed 62**.

Oil pressure (hydraulic) devices 69 are provided between lower portions of the side plates of the frame 6 and side portions of the holder 65 rotatably. Each oil pressure device 69 inclines so that an output shaft side may be lower than a mounting portion to the frame 6.

Accordingly, when the output shaft of one oil pressure device 69 is made to advance and the output shaft of the other oil pressure device 69 is made to recede, the holder 65 swings from its vertical posture on the fixed bed 62. An inclined posture of the holder 65, that is to say, an inclined posture of the lower ram **3*b* can be control by adjusting an angle of swing of the holder 65**.

A roller device 7 having a shaping roller 4 is installed on one side wall of the frame 6. One oil pressure device built in the roller device 7 can displace the shaping roller 4 in the horizontal direction and another oil pressure device built in the roller device 7 can displace the shaping roller 4 in the vertical direction. Similarly, another roller device 8 having a forming roller 40 is installed on another side wall of the frame 6. Two oil pressure devices built in the roller device 8 can adjust the posture of the shaping roller 40 in horizontal and vertical directions.

The operation of the embodiment will now be explained. At first the degree of inclination of the lower ram **3*b* is set up by adjusting degrees of advance of each output shaft of the oil pressure devices 69. In this condition, the initial material 10 is laid on the lower ram 3*b* and then the upper ram 3*a* is lowered by the oil pressure device 64. The rams 3*a*, 3*b* press and expand the initial material 10**. After that each part of the wheel can be formed by the same process as the above mentioned embodiment.

In this embodiment, since the posture of the lower ram **3*b* can be adjusted, the disc part 1 can be formed with the lower ram 3*b* inclined, and then the sectional shape of the rim parts 2 can be shaped with the lower ram 3*b* standing straight. In this method, the side shape of the ram 3*b* which stands vertically has been formed to coincide with the inner surface of the drop center and the inner rim 2*b* of the rim parts 2**.

Figure 8:
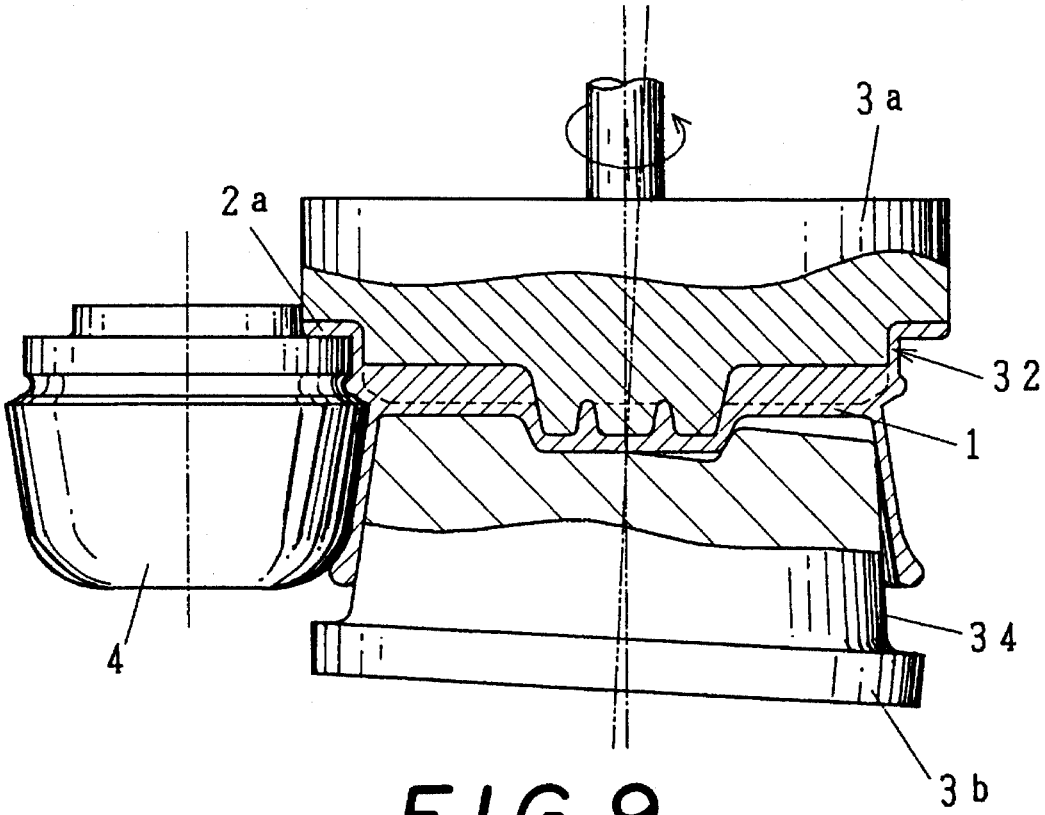
FIG. 8 is a partially-sectional view of the material, the rams and the side roller of another embodiment, shown during the process of forming the disc parts.
Figure 9:
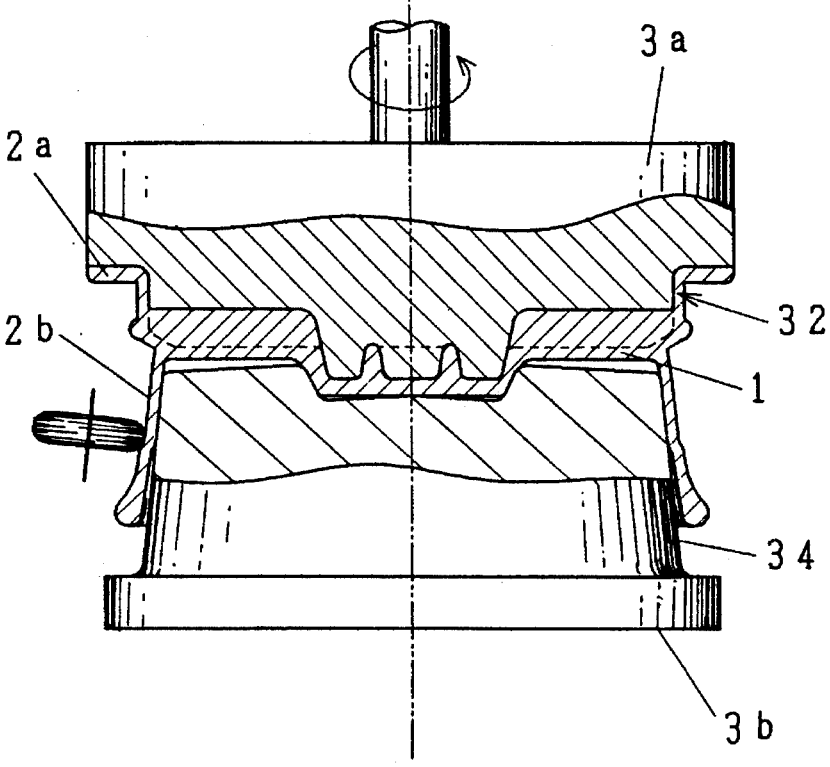
FIG. 9 is a sectional view of the material, rams and roller of another embodiment, shown during the process of forming the rim parts.

As shown in FIG. 8, when the lower ram **3*b* is inclined, the disc part 1, and a part of the rim parts 2 which extends from the drop center to the outer rim 2*a*, are formed. After that when the lower ram 3*b* stands vertically, as shown in FIG. 9, the rest of the rim parts 2, which extends from the drop center to the inner rim 2*b***, can be finished.

In any of the embodiments described above, the angle of inclination of the lower ram **3*b* may be a small angle, for example, in the range of 0.5 to 5 degrees. Hence, in the above mentioned method, when the lower ram 3*b* is changed to the vertical posture from the inclined posture, there is a small space between the outer side surface of the ram 3*b* and the intermediate portions of the rim parts 2. And the intermediate portions of the rim parts 2 are pressed and extended against the outer side surface of the rim 3*b*. Thus, the drop center and the inner rim are finished after the side shape of the lower ram 3*b***.

In this embodiments, the forming roller 40 is a spinning precessing roller, but it is possible to adapt another roller for the forming roller 40.

Figure 10:
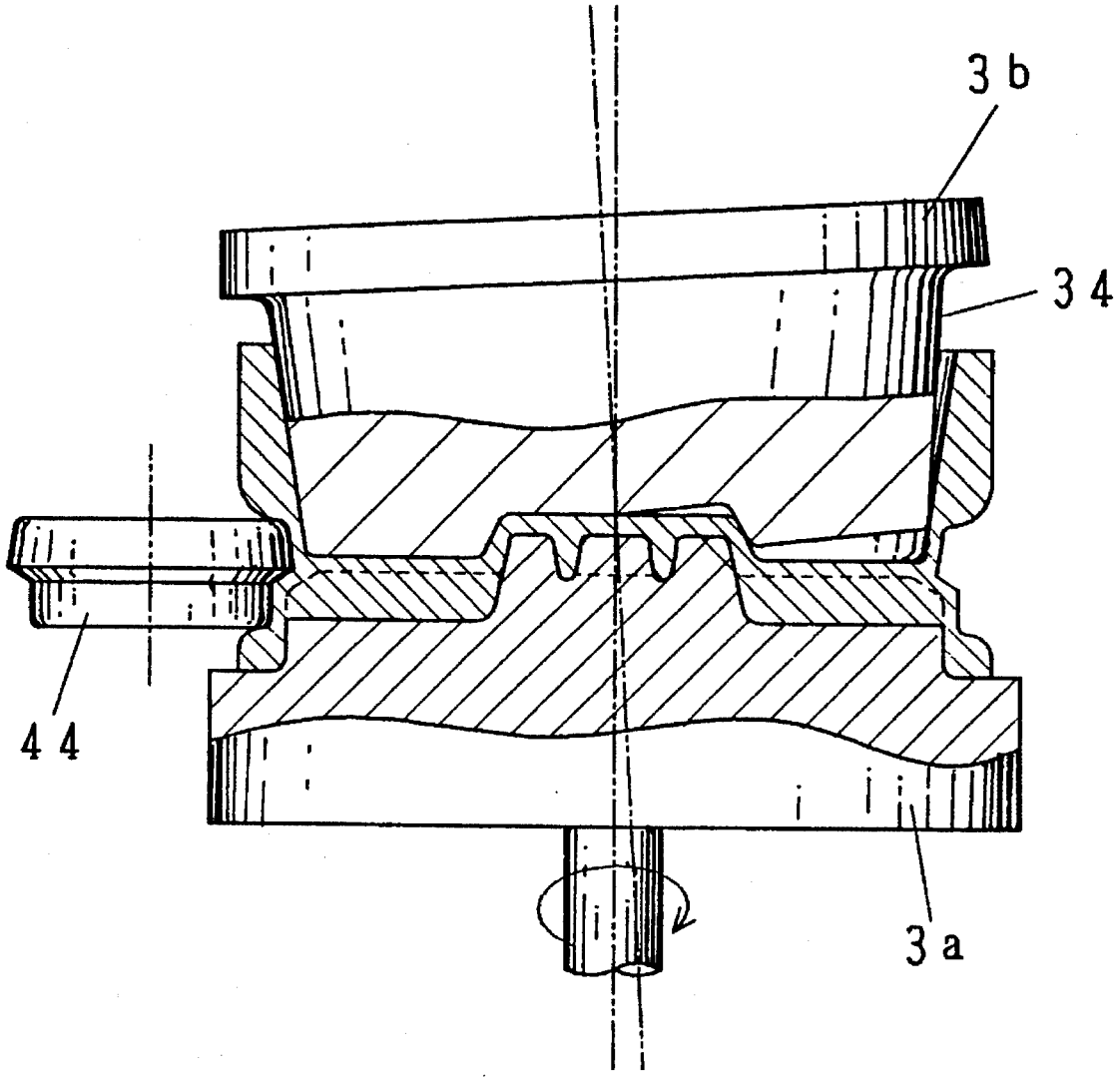
FIG. 10 is a sectional view of the material, rams and another side roller shown during the process of forming the disc part.

As shown in FIG. 10, a side shape of a shaping roller 44 has been formed to coincide with the drop center of the rim parts 2 and when the disc part 1 is formed by the pressure between the rams **3*a*, 3*b*, the forming roller 44 may be only pushed against the peripheral material in the horizontal direction. After that, the outer rim 2*a* and the inner rim 2*b*** can be finished by the former spinning precession.

What is claimed is;

1. A method of shaping a wheel, the wheel including a wheel disc part having a periphery and having first concave and convex patterns and a rim part extending in an axial direction from the periphery of the wheel disc part, the method comprising the steps of:

a. providing a plastically deformable mass of initial material having a central disc part with a periphery and having a peripheral annular part extending in a vertical direction from the periphery of the central disc part;

b. disposing the mass between a pair of mutually opposing first and second rams, with the peripheral annular part fitted on at least one of the rams, the first ram having a first pressing surface and a first peripheral surface, the second ram having a second pressing surface and a second peripheral surface, the first and second pressing surfaces having second concave and convex patterns which are the negative of the first concave and convex patterns of the wheel to be formed;

c. arranging a movable shaping roller outside of the peripheral surfaces of the rams;

d. pressing the central disc part with the rams while rotating the rams on their axes synchronously in the same direction, so that the central disc part intrudes into the second concave patterns at the first and second pressing surfaces so as to form the first convex patterns and is displaced by the second convex portions so as to form the second concave patterns, both without extruding the central disc part out from between the first and second pressing surfaces;

e. pressing the peripheral annular part with the shaping roller so as to form a portion of the rim part, said portion including at least a region from a part of a drop center to the outer rim; and f. finishing raw parts of the peripheral annular part by spinning.

2. A method of shaping a wheel as claimed in claim 1, wherein the central disc part is pressed by the rams, and at the same time, the peripheral annular part is pressed by the shaping roller.

3. A method of shaping a wheel as claimed in claim 2, wherein the shaping roller has a sectional surface which is a negative of a part of the drop center and an outer surface of the outer rim.

4. A method of shaping a wheel as claimed in claim 1, wherein an axis of the first ram is tilted slightly from a perpendicular axis of the second ram, wherein the pressing surface of the first ram has a generally frustoconical shape, and wherein said step e comprises the step of pressing the peripheral annular part with the shaping roller from a tilted side of the first ram at the same time as said step d.

5. A method of shaping a wheel as claimed in claim 4, wherein the shaping roller has a sectional surface which is a negative of a part of the drop center and an outer surface of the outer rim.

6. A method of shaping a wheel as claimed in claim 4, wherein the first ram is movable between a position in which the axis of the first ram stands vertically and a position in which the axis of the first ram is tilted, and wherein a sectional side shape of the peripheral surface of the first ram coincides with a negative of the inner surface of the inner rim and an outer surface of a flange next to the inner rim when the axis of the first ram stands vertically.

7. A method of shaping a wheel as claimed in claim 4, wherein the first ram is movable between a position in which the axis of the first ram stands vertically and a position in which the axis of the first ram is tilted, and wherein a sectional side shape of the peripheral surface of the first ram coincides with a negative of the inner surface of the inner rim and an outer surface of a flange next to the inner rim when the axis of the first ram is tilted.

8. A method of shaping a wheel as claimed in claim 7, wherein the first ram has an angle of inclination in the range of 0.5 to 5 degrees.

9. A method of shaping a wheel as claimed in claim 4, wherein the first ram has an angle of inclination in the range of 0.5 to 5 degrees.

10. A method of shaping a wheel as claimed in claim 1, wherein the shaping roller has a sectional surface which is a negative of a part of the drop center and an outer surface of the outer rim.

11. A method of shaping a wheel as claimed in claim 1, wherein the first ram is tiltable so that an axis thereof is tilted slightly from a perpendicular axis of the second ram, wherein a sectional side shape of the peripheral surface of the first ram coincides with a negative of the inner surface of the inner rim and an outer surface of a flange next to the inner rim when the axis of the first ram stands vertically, and further comprising the step of adjusting a rotational axis of the first ram so that the axes of the two rams are arranged coaxially after said step d or said step e, and before said step f.

12. A method of shaping a wheel as claimed in claim 11, wherein the first ram has an angle of inclination in the range of 0.5 to 5 degrees.

13. A method of shaping a wheel as claimed in claim 1, wherein the first ram is movable between a position in which the axis of the first ram stands vertically and a position in which the axis of the first ram is tilted, and wherein the shaping roller has a sectional side surface which is a negative of a part of the drop center and an outer surface of the outer rim, and said step e comprises the step of pressing the shaping roller against a position on the mass where a distance between the shaping roller and the first peripheral surface of the first ram is smaller than that between the shaping roller and the second peripheral surface of the second ram.

14. A method of shaping a wheel as claimed in claim 1, wherein said step c further includes the step of disposing the shaping roller in contact with an outer side surface of the mass, such that a largest diameter portion of the shaping roller contacts the outer side surface of the central disc part.

15. A method of shaping a wheel as claimed in claim 14, wherein the central disc part of the mass has a thickness equal to that of a thickest portion of the wheel disc part to be formed.

16. A method of shaping a wheel as claimed in claim 15, wherein the central disc part has a volume slightly larger than that of the wheel disc part to be formed.

17. A method of shaping a wheel as claimed in claim 1, wherein the central disc part of the mass has a thickness equal to that of a thickest portion of the wheel disc part to be formed.

18. A method of shaping a wheel as claimed in claim 17, wherein the central disc part has a volume slightly larger than that of the wheel disc part to be formed.

* * * * *